US012637806B2

(12) United States Patent
Hashimoto

(10) Patent No.: US 12,637,806 B2
(45) Date of Patent: May 26, 2026

(54) TWO-LAYER COIL STRUCTURE

(71) Applicant: ASAHI INTECC CO., LTD., Seto (JP)

(72) Inventor: Takaya Hashimoto, Seto (JP)

(73) Assignee: ASAHI INTECC CO., LTD., Seto (JP)

( * ) Notice: Subject to any disclaimer, the term of this patent is extended or adjusted under 35 U.S.C. 154(b) by 0 days.

(21) Appl. No.: 18/667,020

(22) Filed: May 17, 2024

(65) Prior Publication Data

US 2024/0301621 A1 Sep. 12, 2024

Related U.S. Application Data

(63) Continuation of application No. PCT/JP2022/043006, filed on Nov. 21, 2022.

(30) Foreign Application Priority Data

Nov. 25, 2021 (JP) ..... 2021-191463

(51) Int. Cl.
*D07B 1/06* (2006.01)

(52) U.S. Cl.
CPC .... *D07B 1/0673* (2013.01); *D07B 2201/1028* (2013.01); *D07B 2201/1044* (2013.01); *D07B 2201/2001* (2013.01); *D07B 2201/2022* (2013.01)

(58) Field of Classification Search
CPC ..... D07B 1/0673; D07B 2201/1028; D07B 2201/1044; D07B 2201/2001; D07B 2201/2022; A61M 25/0102
See application file for complete search history.

(56) References Cited

U.S. PATENT DOCUMENTS 4,951,677 A * 8/1990 Crowley ..... A61B 8/12 600/463
5,803,812 A 9/1998 Kakiuchi et al.
5,932,035 A * 8/1999 Koger ..... A61B 8/12 148/563
2003/0139689 A1 7/2003 Shturman et al.
(Continued)

FOREIGN PATENT DOCUMENTS

JP H09-49517 A 2/1997
JP H09-504214 A 4/1997
(Continued)

OTHER PUBLICATIONS

Aug. 21, 2025 Extended European Search Report Issued in European Patent Application No. 22898526.3.

*Primary Examiner* — Uyen T Nguyen
(74) *Attorney, Agent, or Firm* — Oliff PLC

(57) ABSTRACT

A torque coil (two-layer coil structure) of the disclosed embodiments includes an inner coil formed by spirally winding metal wire, and an outer coil arranged to be in close contact with the outer periphery of the inner coil and formed by spirally winding metal wire. A winding direction of the inner coil and a winding direction of the outer coil are opposite from each other, and when the torque coil is twisted in the circumferential direction in which the diameter of the inner coil is increased, a change amount of the diameter of the outer coil is larger than a change amount of the diameter of the inner coil. The two-layer coil structure has high twisting rigidity, thus suppressing the occurrence of kinks due to rotational resistance.

4 Claims, 3 Drawing Sheets

(56) References Cited

U.S. PATENT DOCUMENTS

| | | | |
|---|---|---|---|
| 2004/0116833 | A1 | 6/2004 | Kato et al. |
| 2016/0256620 | A1 | 9/2016 | Scheckel et al. |
| 2018/0104440 | A1 | 4/2018 | Hanaoka |
| 2020/0338625 | A1 | 10/2020 | Kageyama |

FOREIGN PATENT DOCUMENTS

| | | | |
|---|---|---|---|
| JP | 2003-062072 | A | 3/2003 |
| JP | 2003-231906 | A | 8/2003 |
| JP | 4553108 | B2 | 9/2010 |
| JP | 2011-177231 | A | 9/2011 |
| JP | 2014-136047 | A | 7/2014 |
| JP | 2017-070803 | A | 4/2017 |
| WO | 92/07594 | A1 | 5/1992 |
| WO | 95/11628 | A1 | 5/1995 |
| WO | 2018/070008 | A1 | 4/2018 |

* cited by examiner

TWO-LAYER COIL STRUCTURE

CROSS-REFERENCE TO RELATED APPLICATIONS

This application is a continuation application of PCT Application No. PCT/JP2022/043006, filed on Nov. 21, 2022, which claims priority to Japanese Patent Application No. 2021-191463, filed on Nov. 25, 2021.

TECHNICAL FIELD

The disclosed embodiments relate to a two-layer coil structure.

BACKGROUND ART

Conventionally, there is known a multi-layer coil structure referred to as a torque coil or a drive shaft, which is provided in a medical catheter or the like and used to transmit a rotating motion of a hand operation part to the distal end portion. For example, Patent Literature 1 discloses the drive shaft 10 that is rotatably provided in the catheter sheath 2 of the ultrasonic catheter 1 and is formed by a multiplex/multilayer tightly wound coil made of metal wire of stainless or the like. Moreover, Patent Literature 2 discloses the hollow drive shaft 16 that is provided in the catheter sheath 18 of the acoustic imaging (ultrasonic imaging) catheter 10 and includes the inner coil 40 and the outer coil 42 of, which are formed of wound nitinol.

CITATION LIST

Patent Literature

[Patent Literature 1] JP 2003-062072 A
[Patent Literature 2] JP H09-504214 A

SUMMARY

Technical Problem

Such a two-layer coil structure is rotationally driven by a drive source such as a motor connected to a hand side, and there is a problem that if the two-layer coil structure is stuck in a catheter during operation of the catheter, for example, and the rotational resistance against the coil part is increased, kinks can easily occur at the coil part. The two-layer coil structure with kinks may not be able to transmit rotation smoothly. Moreover, with the occurrence of kinks, a lead wire connected to the inside of the two-layer coil structure may be broken, thereby disabling the catheter itself.

In view of such aspects, the disclosed embodiments aim at providing a two-layer coil structure having high twisting rigidity and suppressing the occurrence of kinks due to rotational resistance.

Solution to Problem

In order to achieve the above-described object, the disclosed embodiment provides a two-layer coil structure with an inner coil that is formed by spirally winding metal wire and an outer coil that is arranged to be in close contact with an outer periphery of the inner coil and formed by spirally winding metal wire. A winding direction of the inner coil and a winding direction of the outer coil are opposite from each other, and the two-layer coil structure is configured such that: (i) when the two-layer coil structure is twisted in a circumferential direction in which a diameter of the inner coil is increased, a change amount of the diameter of the inner coil is smaller than a change amount of a diameter of the outer coil, and (ii) in a test sample in which the inner coil and outer coil each have a length of 1596 mm, and $d_1$ is the change amount of the diameter of the inner coil when the inner coil of the test sample is twisted by 360° in the circumferential direction in which the diameter of the inner coil is increased, and $d_2$ is the change amount of the diameter of the outer coil when the outer coil of the test sample is twisted by 360° in the circumferential direction in which the diameter of the outer coil is decreased, the values of $d_1$ and $d_2$ satisfy the relation of $-4.5<d_1/d_2<-1.6$.

Advantageous Effects

In the disclosed embodiments, it is possible to provide a two-layer coil structure having high twisting rigidity and suppressing the occurrence of kinks due to rotational resistance.

DESCRIPTION OF EMBODIMENTS

Figure 1:
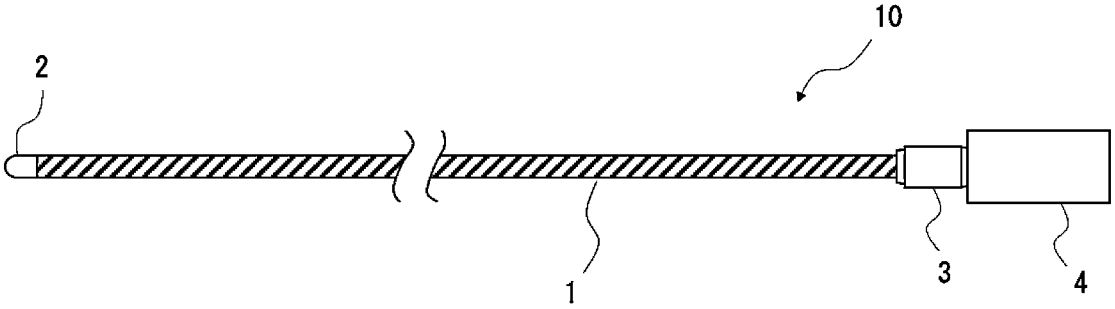
FIG. 1 is a schematic diagram illustrating a structure of a torque coil according to one of the disclosed embodiments.
Figure 2:
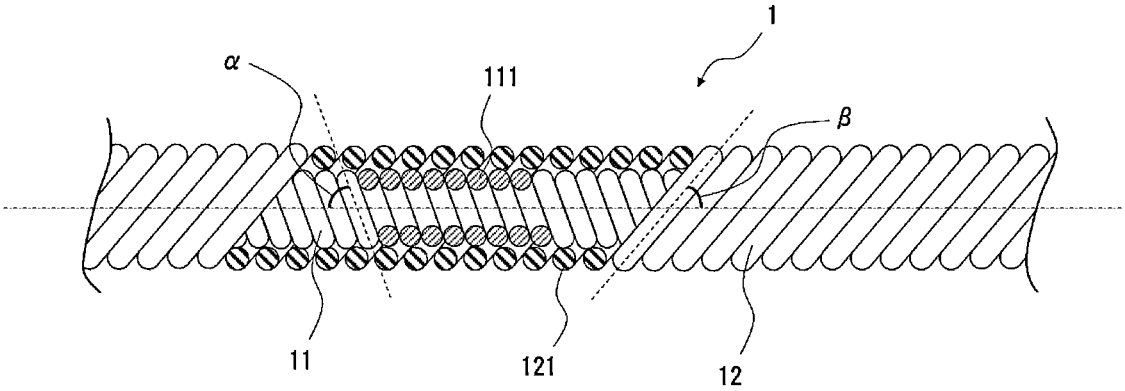
FIG. 2 is a perspective view illustrating a structure of a shaft main body according to the disclosed embodiment.

Hereinafter, the disclosed embodiments will be described with reference to the drawings. FIG. 1 is explanatory schematic view illustrating the entire structure of a torque coil 10 according to the embodiment, and FIG. 2 is a perspective view illustrating a structure of a shaft main body 1 of the torque coil 10. Note that the disclosed embodiments are not limited to ones described below, which are merely examples to illustrate the technical features of the disclosed embodiments. Moreover, the shape and size in each drawing are merely illustrated to facilitate understanding of the contents of the disclosed embodiments, and do not precisely reflect the actual shape and size.

In the specification, the "distal end side" indicates a side of a member that is farthest in a direction along the axial direction of the shaft main body 1 of the torque coil 10, the direction being a direction along which the torque coil 10 advances toward a treatment site. The "proximal end side" indicates a side of a member that is farthest in a direction along the axial direction of the shaft main body 1 of the torque coil 10, the direction being a direction opposite to the above-described distal end side. Moreover, the "distal end" refers to an end on the distal end side of an arbitrary member or portion, and the "proximal end" refers to an end on the proximal end side of an arbitrary member or portion. Furthermore, the "distal end portion" refers to a portion, in an arbitrary member or portion, including the distal end and extending from the distal end toward the proximal end side to the halfway of the above-described member or the like, and the "proximal end portion" refers to a portion, in an arbitrary member or portion, including the proximal end and extending from the proximal end toward the distal end side to the halfway of the above-described member or the like. Note that in FIG. 1 and FIG. 2, the left side in the drawings is the "distal end side" to be inserted into a body in the state inserted in an ultrasonic catheter or the like, and the right side in the drawings is the "proximal end side" connected to a drive source such as a motor.

The torque coil 10 includes, as illustrated in FIG. 1, the long shaft main body 1, a housing 2 attached to the distal end side of the shaft main body 1, and a connector 3 attached to the proximal end side of the shaft main body 1. The shaft main body 1 of the embodiment has a hollow two-layer coil structure including, as illustrated in FIG. 2, an inner coil 11 formed by spirally winding metal wire 111 and an outer coil 12 arranged to be in close contact with the outer periphery of the inner coil 11 and formed by spirally winding metal wire 121.

The housing 2 is attached to the distal end of the shaft main body 1 of the torque coil 10. In a case where the torque coil 10 is used for an ultrasonic imaging catheter, a transducer (not illustrated) for ultrasonic imaging is built in the housing 2, and the housing 2 is attached to the distal end portion of the shaft main body 1 by a known fixing technique such as epoxy resin or an adhesive. Moreover, depending on the application of the torque coil 10, a coil member made of a different material from the shaft main body 1 or a connecting member for the connection to an operation object such as a medical clip may be joined instead of the housing 2, or the distal end portion of the shaft main body 1 may be brazed by a brazing material, and cut into a desired shape.

The connector 3 for the connection to a drive source 4 for rotationally driving the torque coil 10, such as a motor, is attached to the proximal end of the shaft main body 1 of the torque coil 10 by a known fixing technique such as epoxy resin or an adhesive.

Note that the disclosed embodiments also provide a shaft for medical instruments in which the torque coil and the drive source are connected by the connector, and a medical instrument including such a shaft. The above-described shaft is especially suitable for a medical instrument including a motor, and is suitably used as a shaft that is provided with an ultrasonic vibrator at the distal end thereof and used in the intravascular ultrasound (IVUS) method, and as a shaft for in-vivo recovery mechanism that is used to remove a substance from a patient's body lumen, for example. The torque coil of the disclosed embodiments is particularly suitable for use with a shaft that rotates at 1000 rpm or higher, or more preferably at 1500 rpm or higher and is used in the intravascular ultrasound (IVUS) method.

In the embodiment, the outer diameter of the inner coil 11 is set to a range of 0.24 to 0.79 mm, and is preferable to be in a range of 0.3 to 0.5 mm. The inner diameter of the inner coil 11 is set to a range of 0.17 to 0.57 mm, and is preferable to be in a range of 0.2 to 0.4 mm. Moreover, the length in the axial direction of the inner coil 11 is set to a range of 1.0 to 3.0 m. The material of the metal wire 111 forming the inner coil 11 is not especially limited, and austenitic stainless steel such as SUS304 and SUS316, for example, is used.

The inner coil 11 is formed by spirally winding a plurality of metal wires 111 such that no gap is generated between metal wires 111 adjacent to each other in the axial direction of the inner coil 11. In the embodiment, the inner coil 11 is formed by spirally winding 2 to 18 metal wires, and the diameter of each metal wire 111 is set to a range of 0.03 to 0.11 mm. The diameter of each metal wire 111 is preferable to be especially in a range of 0.04 to 0.08 mm. If the inner coil 11 is a single-threaded coil, the rotation performance of the torque coil 10 may be deteriorated.

In the embodiment, the outer diameter of the outer coil 12 is set to a range of 0.3 to 1.0 mm, and is preferable to be in a range of 0.4 to 0.6 mm. The inner diameter of the outer coil 12 is set to a range of 0.24 to 0.79 mm, and is preferable to be in a range of 0.3 to 0.5 mm. The outer coil 12 is arranged in close contact with the outer periphery of the inner coil 11, and thus the inner diameter of the outer coil 12 is set to be substantially equal to the outer diameter of the inner coil 11. Moreover, the length in the axial direction of the outer coil 12 can be equal to that of the inner coil 11, and is set to a range of 1.0 to 3.0 m, for example. The material of the metal wire 121 forming the outer coil 12 is not especially limited, and austenitic stainless steel such as SUS304 and SUS316, for example, is used. The metal wire 111 forming the inner coil 11 and the metal wire 121 forming the outer coil 12 are preferably made of the same material.

The outer coil 12 is formed by spirally winding a plurality of metal wires 121 such that no gap is generated between metal wires 121 adjacent to each other in the axial direction of the outer coil 12. In the embodiment, the outer coil 12 is formed by spirally winding 2 to 18 metal wires, and the diameter of each metal wire 121 is set to a range of 0.03 to 0.50 mm. The diameter of each metal wire 121 is preferable to be in a range of 0.03 to 0.08 mm.

In the embodiment, the metal wire 111 forming the inner coil 11 and the metal wire 121 forming the outer coil 12 are both round wire with a substantially circular section. However, the embodiments are not limited thereto, and the metal wire 111 and the metal wire 121 may be round wire with an elliptical section or flat wire with a substantially rectangular section.

In the shaft main body 1, the outer coil 12 is arranged on the outer periphery of the inner coil 11 such that the winding direction of the inner coil 11 and the winding direction of the outer coil 12 are opposite from each other, as illustrated in FIG. 2. In this manner, when the shaft main body 1 is twisted in the circumferential direction in which the diameter of the inner coil 11 is increased, the diameter of the inner coil 11 is increased, and the diameter of the outer coil 12 is decreased.

Here, the torque coil 10 is formed so that, when the shaft main body 1 is twisted in the circumferential direction in which the diameter of the inner coil 11 is increased, the change amount of the diameter of the outer coil 12 is larger than the change amount of the diameter of the inner coil 11. Specifically, as illustrated in FIG. 2, a winding angle $\alpha$ of the inner coil 11 with respect to the longitudinal axis of the inner coil 11 and a winding angle $\beta$ of the outer coil 12 with respect to the longitudinal axis of the outer coil 12 are made different from each other, and the winding angle $\alpha$ with respect to the longitudinal axis of the inner coil 11 is set to be larger than the winding angle $\beta$ in the with respect to the longitudinal axis of the outer coil 12. In this manner, with the winding angle $\alpha$ of the inner coil 11 larger than the winding angle $\beta$ of the outer coil 12 (that is, the twisting angle of the inner coil 11 is more upright than the twisting angle of the outer coil 12), the change amount of the diameter of the outer coil 12 is larger than the change amount of the diameter of the inner coil 11 when the shaft main body 1 is twisted in the circumferential direction in which the diameter of the inner coil 11 is increased, as described above.

The relation between the winding angle $\alpha$ in the longitudinal section direction of the inner coil 11 and the winding angle $\beta$ in the longitudinal section direction of the outer coil 12 is determined depending on the combination of the wire diameter of the metal wires 111 and 121 forming the inner coil 11 and the outer coil 12, respectively, and the set number of wires. For example, if the diameter of the wire forming the coil is fixed, the winding angle in the longitudinal section direction of the coil is decreased as the number of wires of the coil is increased, and is increased as the number of wires of the coil is decreased. Moreover, if the number of wires forming the coil is fixed, the winding angle in the longitudinal section direction of the coil is decreased as the diameter of the wire forming the coil is increased, and is increased as the diameter of the wire forming the coil is decreased.

In the above-described torque coil 10, the winding direction of the inner coil 11 and the winding direction of the outer coil 12 are opposite from each other. Thus, when the torque coil 10 is twisted in the circumferential direction in which the diameter of the inner coil 11 is increased, the diameter of the inner coil 11 is increased, while the diameter of the outer coil 12 is decreased. As a result, the outer coil 12 and the inner coil 11 are pressed against each other. Then, with the change amount of the diameter of the outer coil 12 larger than the change amount of the diameter of the inner coil 11, the outer coil 12 strongly tightens the inner coil 11, so that the layers of the outer coil 12 and the inner coil 11 are brought into firm and close contact with each other. Thus, the twisting rigidity of the torque coil 10 is enhanced, thereby suppressing the occurrence of kinks due to rotational resistance.

The above description relates to the disclosed embodiments of a torque coil (two-layer coil structure) with reference to the drawings. However, the embodiments are not limited to the above-described one, and various changes can be made. For example, the shapes, lengths, diameters, and the like of the inner coil 11 and the outer coil 12 forming the torque coil 10 may be appropriately set in accordance with the use purpose, position, or the like. Moreover, lead wire or the like may be inserted into the shaft main body 1, or a member other than the inner coil 11 and the outer coil 12, such as a reinforcing body or an X-ray impermeable marker, for example, may be provided in the shaft main body 1.

EXAMPLES

Hereinafter, the disclosed embodiments will be described more concretely using examples and the like, but the embodiments are not limited to these examples and the like.

In order to verify that the torque coil of the disclosed embodiment has excellent twisting rigidity, there were produced a plurality of testing torque coils each including an inner coil that is a multi-threaded coil formed by spirally winding a plurality of metal wires and an outer coil that is a multi-threaded coil arranged in close contact with the outer periphery of the inner coil and formed by spirally winding a plurality of metal wires, and the maximum torque force and the twisting rigidity were measured using a motor and a torque sensor.

A plurality of testing torque coils were produced while changing the diameter and number of wires of the inner coil and the outer coil. All of the testing torque coils were produced such that the inner diameter is 0.32 mm and the length is 1606 mm. The structures of the inner coil and the outer coil of the produced testing torque coils are shown in Table 1.

TABLE 1

| | Inner coil | | | | Outer coil | | | |
|---|---|---|---|---|---|---|---|---|
| No. | Wire diameter [mm] | Number of wires | Pitch [mm] | Twisting angle [°] | Wire diameter [mm] | Number of wires | Pitch [mm] | Twisting angle [°] |
| Example 1 | 0.03 | 8 | 0.264 | 76.5 | 0.09 | 8 | 0.880 | 58.8 |
| Example 2 | 0.04 | 8 | 0.853 | 72.4 | 0.08 | 8 | 0.762 | 68.0 |
| Example 3 | 0.05 | 8 | 0.457 | 68.5 | 0.07 | 8 | 0.652 | 67.0 |
| Comparative Example 1 | 0.06 | 8 | 0.565 | 64.7 | 0.06 | 8 | 0.549 | 70.7 |
| Comparative Example 2 | 0.07 | 8 | 0.684 | 61.0 | 0.05 | 8 | 0.450 | 74.3 |
| Comparative Example 3 | 0.08 | 8 | 0.819 | 57.4 | 0.04 | 8 | 0.356 | 77.7 |
| Example 4 | 0.06 | 8 | 0.565 | 64.7 | 0.06 | 16 | 1.320 | 50.0 |
| Example 5 | 0.06 | | 0.565 | 64 7 | 0.06 | 14 | 1.082 | 55.4 |
| Example 6 | 0.06 | 8 | 0.565 | 64.7 | 0.06 | 12 | 0.882 | 80.7 |
| Example 7 | 0.06 | 8 | 0.565 | 64.7 | 0.05 | 10 | 0.707 | 65.6 |
| Comparative Example 4 | 0.06 | 8 | 0.565 | 64.7 | 0.06 | 8 | 0.549 | 70.7 |
| Comparative Example 5 | 0.06 | 10 | 0.748 | 57.9 | 0.06 | 8 | 0.549 | 70.7 |
| Comparative Example 6 | 0.06 | 12 | 0.973 | 50.8 | 0.06 | 8 | 0.549 | 70.7 |
| Comparative Example 7 | 0.06 | 14 | 1.275 | 43.1 | 0.06 | 8 | 0.549 | 70.7 |

In the examples 1 to 3 and the comparative examples 1 to 3 in Table 1, the wire diameters of the inner coil and the outer coil are changed while the number of wires of the inner coil and the outer coil is fixed to eight. Meanwhile, in the examples 4 to 7 and the comparative examples 4 to 7 in Table 1, the number of wires of the inner coil and the outer coil is changed while the wire diameters of the inner coil and the outer coil are fixed to 0.06 mm. Note that the pitch in Table 1 indicates a length of one cycle in the coil axis direction where the wire is wound.

Next, assuming the case where one end of each of the produced testing torque coils of the examples and comparative examples is fixed and the other end is twisted by 360°, there were calculated a change amount $d_1$ of the diameter of the inner coil when the inner coil having a length of 1596 mm is twisted by 360° in a circumferential direction that is the direction where the diameter of the inner coil is increased. There was also calculated a change amount $d_2$ of the diameter of the outer coil when the outer coil having a length of 1596 mm is twisted by 360° in a circumferential direction that is the direction where the diameter of the outer coil is decreased. The measurement results are shown in Table 2.

Note that the theoretical change amount $d_1$ of the diameter of the inner coil and change amount $d_2$ of the diameter of the outer coil were calculated with a premise that the length of each coil is 1596 mm, even though the length of the actually produced testing torque coil is 1606 mm. This is because both ends of the testing torque coil is attached to a motor and a torque sensor to measure a maximum torque force and twisting rigidity for each of the produced testing torque coils of the examples and comparative examples, as described later, and 5 mm of each of the both ends is chucked to a connector for attachment to the motor and the torque, which makes the length of the testing torque coil subjected to measurement of the maximum torque force and twisting rigidity 1596 mm.

(4) For the inner coil, the periphery of the circle with a PCD after twisting in the diameter increasing direction as a diameter was found by "PCDπ+({twisting degree/360°}×PCDπ)", and the periphery was divided by π to calculate a PCD after twisting in the diameter increasing direction.

(5) For the outer coil, the periphery of the circle with a PCD after twisting in the diameter decreasing direction as a diameter was found by "PCDπ−({twisting degree/360°}×PCDπ)", and the periphery was divided by π to calculate a PCD after twisting in the diameter decreasing direction.

(6) The "PCD before twisting the inner coil" is deducted from the "PCD after twisting the inner coil in the diameter increasing direction" to find a "change amount $d_1$ of the diameter of the inner coil", while the "PCD before twisting the outer coil" is deducted from the "PCD after twisting the outer coil in the diameter decreasing direction" to find a "change amount $d_2$ of the diameter of the outer coil".

(7) With these, the ratio ($d_1/d_2$) of the change amount $d_1$ of the diameter of the inner coil and the change amount $d_2$ of the diameter of the outer coil ($d_1/d_2$) was calculated.

TABLE 2

| | Inner coil | | | | | | Outer coil | | | | | | |
|---|---|---|---|---|---|---|---|---|---|---|---|---|---|
| No. | PCD*π | Pitch number | Twisting degree/P | PCD*π after twisting | PCD after twisting | Radial direction change amount d, [mm] | PCD*π | Pitch number | Twisting degree/P | PCD*π after twisting | PCD after twisting | Radial direction change amount d, [mm] | d2/d1 |
| Example 1 | 1.0996 | 6.055 | 0.06 | 1.0997 | 0.3501 | 0.00006 | 1.4765 | 1.814 | 0.20 | 1.4774 | 0.4703 | −0.00026 | −4.48094 |
| Example 2 | 1.1310 | 4.463 | 0.08 | 1.1312 | 0.3601 | 0.00008 | 1.5080 | 2.096 | 0.17 | 1.5087 | 0.4802 | −0.00023 | −2.83898 |
| Example 3 | 1.1624 | 3.489 | 0.10 | 1.1627 | 0.3701 | 0.00011 | 1.5394 | 2.449 | 0.15 | 1.5400 | 0.4902 | −0.00020 | −1.88690 |
| Comparative Example 1 | 1.1938 | 2.823 | 0.13 | 1.1942 | 0.3801 | 0.00013 | 1.5708 | 2.909 | 0.12 | 1.5713 | 0.5002 | −0.00017 | −2.27689 |
| Comparative Example 2 | 1.7252 | 2.332 | 0.15 | 1.2257 | 0.3902 | 0.00017 | 1.6022 | 3.543 | 0.10 | 1.6027 | 0.5101 | −0.00014 | −0.86089 |
| Comparative Example 3 | 1.2566 | 1.949 | 0.18 | 1.2573 | 0.4002 | 0.00021 | 1.6336 | 4.480 | 0.08 | 1.6340 | 0.5201 | −0.00012 | −0.86881 |
| Example 4 | 1.1938 | 2.823 | 0.13 | 1.1942 | 0.3801 | 0.00013 | 1.5708 | 1.209 | 0.30 | 1.5721 | 0.5004 | −0.00041 | −0.07214 |
| Example 5 | 1.1938 | 2.823 | 0.13 | 1.1942 | 0.3801 | 0.00013 | 1.5708 | 1.475 | 0.24 | 1.5719 | 0.5003 | −0.00034 | −2.51795 |
| Example 6 | 1.1938 | 2.823 | 0.13 | 1.1942 | 0.3801 | 0.00013 | 1.5708 | 1.810 | 0.20 | 1.5717 | 0.5003 | −0.00029 | −2.06198 |
| Example 7 | 1.1938 | 2.823 | 0.13 | 1.1942 | 0.3801 | 0.00013 | 1.5708 | 2.259 | 0.16 | 1.5715 | 0.5002 | −0.00022 | −1.64446 |
| Comparative Example 4 | 1.1938 | 2.823 | 0.13 | 1.1942 | 0.3801 | 0.00013 | 1.5708 | 2.909 | 0.12 | 1.5713 | 0.5002 | −0.00017 | −1.27689 |
| Comparative Example 5 | 1.1938 | 2.133 | 0.17 | 1.1944 | 0.3802 | 0.00018 | 1.5708 | 2.909 | 0.12 | 1.5713 | 0.5002 | −0.00017 | −0.96452 |
| Comparative Example 6 | 1.1938 | 1.640 | 0.22 | 1.1945 | 0.3802 | 0.00023 | 1.5708 | 2.909 | 0.12 | 1.5713 | 0.5002 | −0.00017 | −0.74160 |
| Comparative Example 7 | 1.1938 | 1.252 | 0.29 | 1.1948 | 0.3803 | 0.00030 | 1.5708 | 2.909 | 0.12 | 1.5713 | 0.5002 | −0.00017 | −0.56625 |

The theoretical change amount $d_1$ of the diameter of the inner coil and change amount $d_2$ of the diameter of the outer coil in each of the examples and comparative examples, and ratios of the change amount $d_1$ of the diameter of the inner coil and change amount $d_2$ of the diameter of the outer coil ($d_1/d_2$), which are shown in Table 2, were calculated in the following method.

(1) The PCD of each of the inner coil and the outer coil was found. Here, a PCD is a diameter of a virtual circle with a center of the coil as a center in a transverse section view of the coil, the virtual circle passing the center in the radial direction of each wire forming the coil, and is a value calculated by "coil inner diameter+wire length in radial direction".

(2) The periphery of the circle with a PCD as a diameter was found by "PCD×π" for each of the inner coil and the outer coil.

(3) The twisting degree was found by "twisting angle (360° in the examples)/pitch number" for each of the inner coil and the outer coil. Note that the pitch number is found by "coil length/length of one pitch". The length of one pitch was calculated by averaging 10 pitches measured actually.

Note that the twisting angle was set to 360° in the examples but in a case where the length of the inner coil and the outer coil is smaller than 1596 mm, the above-described $d_1/d_2$ may be found with the twisting angle calculated by "360[°]×{(length of inner coil and outer coil [mm])/1596 [mm]}".

Subsequently, the produced testing torque coil of each of the examples and comparative examples was attached to a guide wire transmission characteristics measuring device PT-1950GHS (by PROTEC) including a motor and a torque sensor, and rotated in a forward direction by the motor and twisted so as to measure the maximum torque force and twisting rigidity of the testing torque coil of each of the examples and comparative examples. The measurement was performed a plurality of times for each of the examples and comparative examples, and the average value was calculated as a measurement result. The measurement results are shown in Table 3.

TABLE 3

| No. | d2/d1 | Maximum torque force [mN · m] | Twisting rigidity [mN · m/deg] |
|---|---|---|---|
| Example 1 | −4.48094 | 2.995 | 0.001198 |
| Example 2 | −2.83898 | 4.168 | 0.001502 |
| Example 3 | −1.88690 | 2.409 | 0.001416 |
| Comparative Example 1 | −1.27689 | 0.944 | 0.000772 |
| Comparative Example 2 | −0.86089 | 0.872 | 0.000633 |
| Comparative Example 3 | −0.56561 | 0.907 | 0.000665 |
| Example 4 | −3.07214 | 12.874 | 0.001813 |
| Example 5 | −2.51795 | 7.941 | 0.001584 |
| Example 6 | −2.05198 | 5.029 | 0.001919 |
| Example 7 | −1.64446 | 2.269 | 0.001500 |
| Comparative Example 4 | −1.27689 | 0.944 | 0.000772 |
| Comparative Example 5 | −0.96452 | 0.970 | 0.000794 |
| Comparative Example 6 | −0.74160 | 0.630 | 0.000650 |
| Comparative Example 7 | −0.56625 | 0.494 | 0.000386 |

Figure 3A:
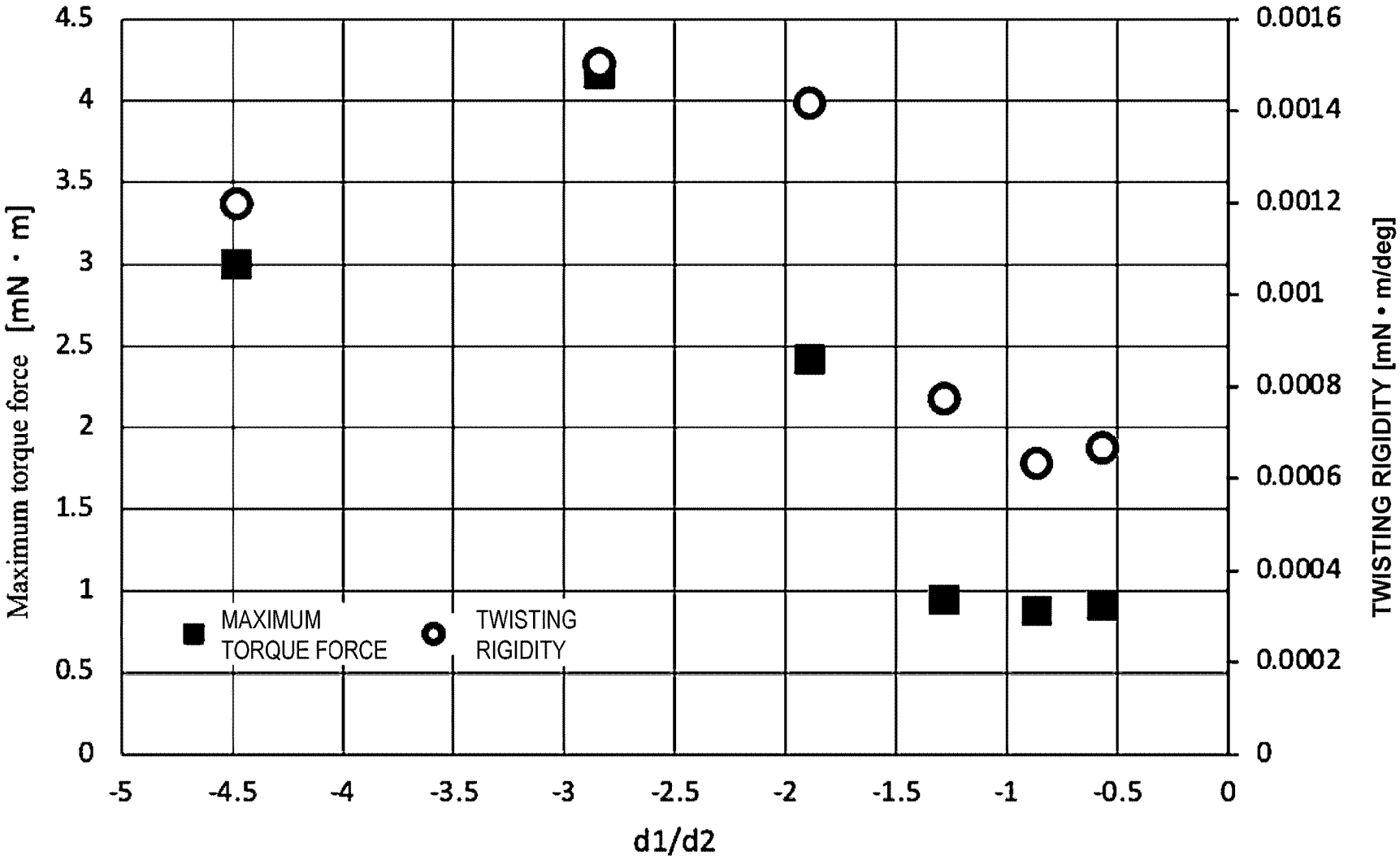
FIGS. 3A and 3B are graphs illustrating the relation between the ratio of change amounts in a radial direction of the inner coil and the outer coil and the maximum torque force and the twisting rigidity in torque coils.
Figure 3B:
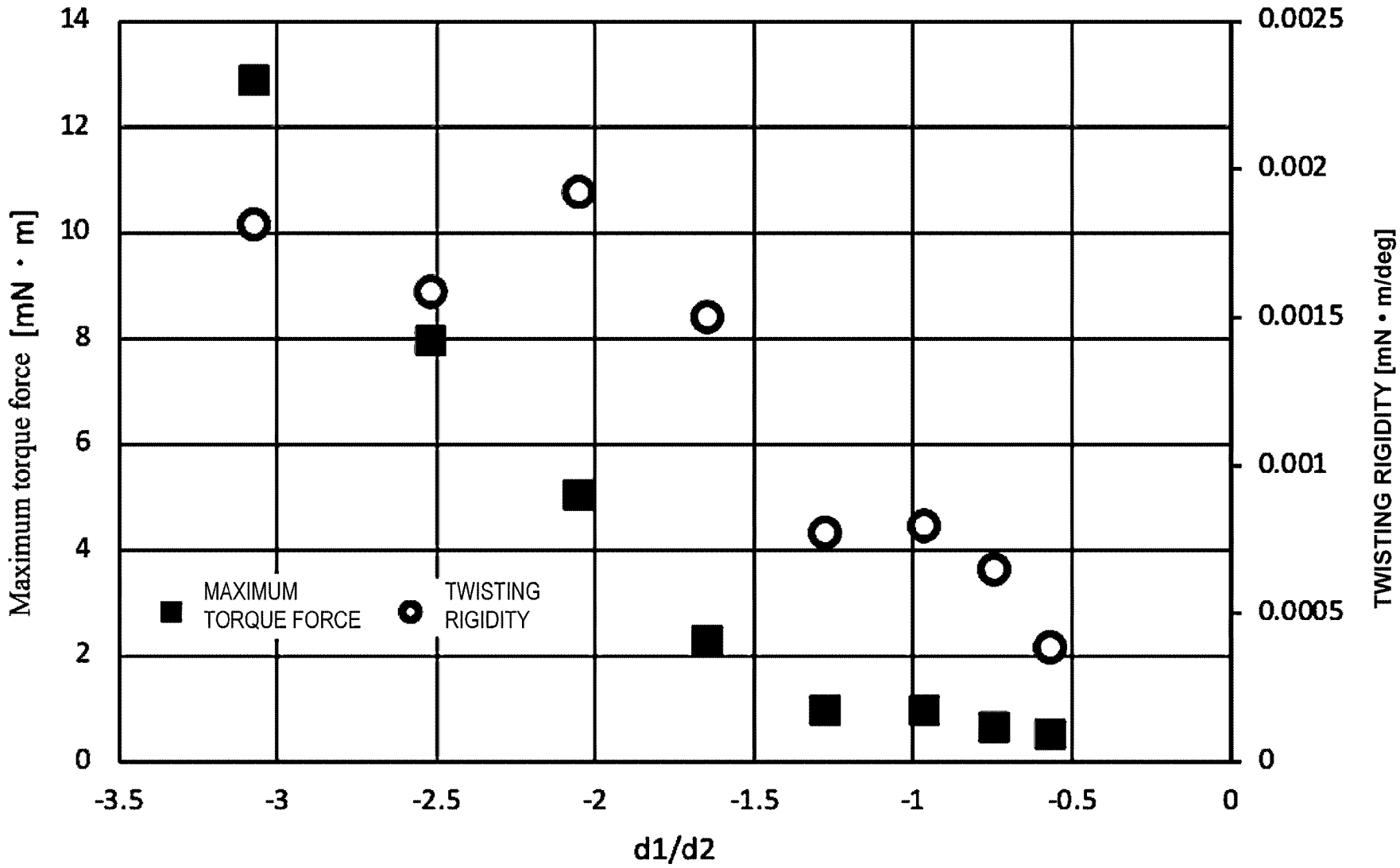

FIG. 3 is a graph illustrating the relation between the ratio of change amounts in a radial direction of the inner coil and the outer coil and the maximum torque force and the twisting rigidity in the torque coils of the examples 1 to 7 and comparative examples 1 to 7 on the basis of the measurement results shown in Table 3. FIG. 3A is a graph regarding the examples 1 to 3 and comparative examples 1 to 3, and FIG. 3B is a graph regarding the examples 4 to 7 and comparative examples 4 to 7.

As is clear from FIG. 3, the torque coils of the examples 1 to 7 have more excellent twisting rigidity than the torque coils of the comparative examples 1 to 7. Especially in a case where the change amount $d_1$ of the diameter of the inner coil when the inner coil having a length of 1596 mm is twisted by 360° in the circumferential direction being the direction where the diameter of the inner coil is increased, and the change amount $d_2$ of the diameter of the outer coil when the outer coil having a length of 1596 mm is twisted by 360° in the circumferential direction being the direction where the diameter of the outer coil is decreased, satisfy the relation of $-4.5<d_1/d_2<-1.6$, the maximum torque force of the torque coil (two-layer coil structure) is improved, thereby achieving a torque coil having more excellent twisting rigidity.

It is understood that especially in the torque coil configured such that the diameters of wires of the inner coil and the outer coil are same and the number of wires of the outer coil is larger than that of the inner coil, such as the torque coils of the examples 4 to 7, the twisting rigidity is extremely excellent, and the maximum torque force is also significantly improved.

Additional Description and Features

A disclosed embodiment provides a two-layer coil structure, including: an inner coil that is formed by spirally winding metal wire; and an outer coil that is arranged to be in close contact with an outer periphery of the inner coil and formed by spirally winding metal wire, in which a winding direction of the inner coil and a winding direction of the outer coil are opposite from each other. When the two-layer coil structure is twisted in a circumferential direction of the two-layer coil structure in which a diameter of the inner coil is increased, a change amount of the diameter of the inner coil is smaller than a change amount of a diameter of the outer coil, a sample length of 1596 mm is set as one unit length of each of the inner coil and the outer coil, and the change amount $d_1$ of the diameter of the inner coil when the inner coil of the one unit length is twisted by 360° in the circumferential direction being the direction where the diameter of the inner coil is increased, and the change amount $d_2$ of the diameter of the outer coil when the outer coil of the one unit length is twisted by 360° in the circumferential direction being the direction where the diameter of the outer coil is decreased, satisfy the relation of $-4.5<d_1/d_2<-1.6$ (Disclosed embodiment 1).

In such a disclosed embodiment (Disclosed embodiment 1), the winding direction of the inner coil and the winding direction of the outer coil are opposite from each other. Thus, when the two-layer coil structure is twisted in the circumferential direction being the direction where the diameter of the inner coil is increased, the diameter of the inner coil is increased, while the diameter of the outer coil is decreased. As a result, the outer coil and the inner coil are pressed against each other. Then, with the change amount of the diameter of the inner coil smaller than the change amount of the diameter of the outer coil, the outer coil strongly tightens the inner coil, so that the layers of the outer coil and the inner coil are brought into firm and close contact with each other. Thus, the twisting rigidity of the two-layer coil structure is enhanced, which suppresses the occurrence of kinks due to rotational resistance. Especially, in a case where a length 1596 mm is set as one unit length of each of the inner coil and the outer coil, and the change amount $d_1$ of the diameter of the inner coil when the inner coil of the one unit length is twisted by 360° in the circumferential direction being the direction where the diameter of the inner coil is increased, and the change amount $d_2$ of the diameter of the outer coil when the outer coil of the one unit length is twisted by 360° in the circumferential direction being the direction where the diameter of the outer coil is decreased, satisfy the relation of $-4.5<d_1/d_2<-1.6$, the maximum torque force of two-layer coil structure is improved, thereby achieving the two-layer coil structure having more excellent twisting rigidity.

In the above-described disclosed embodiment (Disclosed embodiment 1), the inner coil is preferably formed by spirally winding 2 to 18 metal wires.

REFERENCE SIGNS LIST

10 torque coil (two-layer coil structure)
- 1 shaft main body
  - 11 inner coil
  - 12 outer coil
- 2 housing
- 3 connector
- 4 motor

What is claimed is:

1. A two-layer coil structure, comprising:

an inner coil that is formed by spirally winding metal wires; and an outer coil that is arranged to be in close contact with an outer periphery of the inner coil and formed by spirally winding metal wires, wherein a winding direction of the inner coil and a winding direction of the outer coil are opposite from each other, a material forming each of the inner coil and the outer coil is stainless steel of SUS304 or SUS316, a wire diameter of the metal wires forming each of the inner coil and the outer coil is in a range of 0.03 mm to 0.11 mm, an outer diameter of the inner coil is in a range of 0.3 mm to 0.5 mm, an inner diameter of the inner coil is in a range of 0.2 mm to 0.4 mm, an outer diameter of the inner coil is in a range of 0.4 mm to 0.6 mm, an inner diameter of the inner coil is in a range of 0.3 mm to 0.5 mm, each of the inner coil and the outer coil is formed by spirally winding 8 to 16 metal wires, and a number of the metal wires forming the outer coil is larger than a number of the metal wires forming the inner coil, wherein the two-layer coil structure is configured such that:

(i) when the two-layer coil structure is twisted in a circumferential direction in which a diameter of the inner coil is increased, a change amount of the diameter of the inner coil is smaller than a change amount of a diameter of the outer coil, and (ii) in a test sample in which the inner coil and outer coil each have a length of 1596 mm, and $d_1$ is the change amount of the diameter of the inner coil when the inner coil of the test sample is twisted by 360° in the circumferential direction in which the diameter of the inner coil is increased, and $d_2$ is the change amount of the diameter of the outer coil when the outer coil of the test sample is twisted by 360° in the circumferential direction in which the diameter of the outer coil is decreased, the values of $d_1$ and $d_2$ satisfy the relation of $-4.5<d_2/d_1<-1.6$.

2. The two-layer coil structure according to claim 1, wherein a winding angle α of the inner coil with respect to a longitudinal axis of the inner coil and a winding angle β of the outer coil with respect to a longitudinal axis of the outer coil are different from each other, the winding angle α being the smallest angle of the inner coil to the longitudinal axis and the winding angle β being the smallest angle of the outer coil to the longitudinal axis.

3. The two-layer coil structure according to claim 2, wherein the winding angle α is larger than the winding angle β.

4. The two-layer coil structure according to claim 1, wherein a wire diameter of the metal wires forming the inner coil and a wire diameter of the metal wires forming the outer coil are the same.

* * * * *